US009341136B2

(12) United States Patent
Williams et al.

(10) Patent No.: US 9,341,136 B2
(45) Date of Patent: May 17, 2016

(54) ENGINE HAVING COMPOSITE CYLINDER BLOCK

(71) Applicant: Ford Global Technologies, LLC, Dearborn, MI (US)

(72) Inventors: Rick L. Williams, Canton, MI (US); Clifford E. Maki, New Hudson, MI (US); Robert Gordon Rentschler, Dearborn, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 119 days.

(21) Appl. No.: 14/101,213

(22) Filed: Dec. 9, 2013

(65) Prior Publication Data

US 2015/0159582 A1 Jun. 11, 2015

(51) Int. Cl.

| | |
|---|---|
| ***F02F 7/00*** | (2006.01) |
| ***F02F 1/18*** | (2006.01) |
| ***F02F 1/10*** | (2006.01) |
| ***F02F 1/16*** | (2006.01) |
| *F02F 1/00* | (2006.01) |

(52) U.S. Cl.

CPC . *F02F 1/18* (2013.01); *F02F 1/108* (2013.01); *F02F 1/163* (2013.01); *F02F 7/0053* (2013.01); *F02F 1/004* (2013.01); *F02F 2007/0041* (2013.01); *F02F 2007/0063* (2013.01)

(58) Field of Classification Search

CPC ..... F02F 1/16; F02F 1/004; F02F 1/045; F02F 1/102; F02F 1/18; F02F 1/108; F02F 1/163; F02F 7/0053; F02F 2007/0041; F02F 2007/0063

USPC ..... 123/193.2, 41.35

See application file for complete search history.

(56) References Cited

U.S. PATENT DOCUMENTS

| | | | | |
|---|---|---|---|---|
| 2,996,050 | A * | 8/1961 | Caris | 123/41.72 |
| 3,090,368 | A * | 5/1963 | Buchwald | 123/90.25 |
| 4,473,042 | A | 9/1984 | Kikuchi | |
| 4,700,444 | A | 10/1987 | Yamagata | |
| 4,922,870 | A | 5/1990 | Pietsch et al. | |

(Continued)

FOREIGN PATENT DOCUMENTS

| | | | |
|---|---|---|---|
| CN | 1718374 | A | 1/2006 |
| CN | 1745238 | A | 3/2006 |

(Continued)

OTHER PUBLICATIONS

Fujine, Manabu et al., "Development of Metal Matrix Composite for Cylinder Block," Seoul 2000 FISITA World Automotive Congress, Paper No. F2000A065, Seoul, Korea, Jun. 12-15, 2000, 5 pages.

(Continued)

*Primary Examiner* — Marguerite McMahon

(74) *Attorney, Agent, or Firm* — Greg Brown; Alleman Hall McCoy Russell & Tuttle LLP

(57) ABSTRACT

An engine is provided. The engine includes a thermal set composite cylinder block including a front engine cover attachment interface and a transmission attachment interface and a cylinder liner integrally molded with the composite cylinder block, the cylinder liner defining a portion of a boundary of a cylinder. The engine further includes a bulkhead insert extending through the thermal set composite cylinder block and is directly coupled to a cylinder head.

19 Claims, 4 Drawing Sheets

(56) References Cited

U.S. PATENT DOCUMENTS

| | | | | |
|---|---|---|---|---|
| 5,357,921 | A * | 10/1994 | Katoh et al. | 123/193.2 |
| 5,370,087 | A * | 12/1994 | Guimond et al. | 123/54.6 |
| 5,687,634 | A | 11/1997 | Ransone | |
| 5,727,511 | A | 3/1998 | Omura et al. | |
| 5,749,331 | A * | 5/1998 | Pettersson et al. | 123/193.2 |
| 6,283,081 | B1 * | 9/2001 | Ozeki | 123/193.2 |
| 6,308,680 | B1 | 10/2001 | Prior | |
| 6,553,957 | B1 * | 4/2003 | Ishikawa et al. | 123/193.2 |
| 7,322,320 | B2 | 1/2008 | Sugano | |
| 7,726,273 | B2 * | 6/2010 | Azevedo et al. | 123/193.2 |
| 8,327,817 | B2 | 12/2012 | Palazzolo et al. | |
| 2003/0056645 | A1 * | 3/2003 | Land et al. | 92/171.1 |
| 2005/0173091 | A1 | 8/2005 | Cantu-Gonzalez et al. | |
| 2006/0086327 | A1 | 4/2006 | Flynn et al. | |
| 2006/0102110 | A1 | 5/2006 | Takenaka et al. | |

FOREIGN PATENT DOCUMENTS

| | | | |
|---|---|---|---|
| EP | 0494532 | A1 | 12/1991 |
| EP | 1457658 | A2 | 9/2004 |
| EP | 1681454 | A2 | 7/2006 |
| EP | 1843029 | A2 | 10/2007 |

OTHER PUBLICATIONS

Lenny, John Jr., "Replacing the Cast Iron Liners for Aluminum Engine Cylinder Blocks: A Comparative Assessment of Potential Candidates," Engineering Thesis Submitted to Graduate Faculty of Rensselaer Polytechnic Institute, Hartford, Connecticut, Apr. 2011, 66 pages.

Maki, Clifford E. et al., "Engine Having Composite Cylinder Block," U.S. Appl. No. 14/101,199, filed Dec. 9, 2013, 29 pages.

"The technology behind Ford's Lightweight Concept Vehicle; prospects for Mach-II with 50% mass reduction difficult," Green Car Congress, http://www.greencarcongress.com/2014/06/20140618-mmlv.html, Jun. 18, 2014, pp. 1-9, relevant p. 4.

Skszek, Tim et al., "Multi-Material Lightweight Vehicles: Mach-II Design," 2014 DOE Hydrogen and Fuel Cells Program and Vehicle Technologies Office Annual Merit Review and Peer Evaluation Meeting about multi-material lightweight vehicles: Mach II design, Jun. 17, 2014, 27 slides, relevant slide: 25.

* cited by examiner

ENGINE HAVING COMPOSITE CYLINDER BLOCK

FIELD

The present disclosure relates to an engine having a thermal-molded composite cylinder block and cylinder liner and bulkhead insert integrated into the cylinder block.

BACKGROUND AND SUMMARY

In engine design there may be trade-offs between strength, weight, and other material properties of materials used to construct the cylinder head and block. For example, iron has been used to manufacture cylinder blocks. Cast iron may have several benefits over other materials, such as a smaller volume to strength ratio and a smaller friction coefficient, decreasing the engine's size and increasing combustion chamber longevity. However, cast iron cylinder blocks may have a low strength to weight ratio, are more susceptible to corrosion, and have undesirable heat transfer characteristics. To reduce block weight and increase the amount of heat transferred to water jackets, cylinder block may be cast out of aluminum. However, aluminum cylinder blocks have several drawbacks, such as high friction coefficients and larger volume to strength ratios.

U.S. Pat. No. 5,370,087 discloses an engine having a composite cylinder case enclosing metal cylinder banks The inventors have recognized several disadvantages with the cylinder block disclosed in U.S. Pat. No. 5,370,087. Firstly, the cylinder case enclosing the cylinder banks is spaced away from the cylinder banks to enable coolant to flow around the cylinders. This type of arrangement decreases the structural integrity of the engine when compared to engines cast via a single continuous piece of metal. Therefore, forces transferred to the engine via external components such as the transmission may damage the cylinder case.

The inventors herein have recognized the above issues and developed an engine. The engine includes a thermal set composite cylinder block including a front engine cover attachment interface and a transmission attachment interface and a cylinder liner integrally molded with the composite cylinder block, the cylinder liner defining a portion of a boundary of a cylinder. The engine further includes a bulkhead insert extending through the thermal set composite cylinder block and is directly coupled to a cylinder head.

In this way, a composite material integrally molded with a cylinder liner and bulkhead insert may be used to form a portion of the engine to increase the engine's strength to weight ratio. Furthermore, the cylinder liner and bulkhead insert may comprise a metal or other suitable material having more desirable abrasion and heat transfer characteristics around the combustion chamber. In this way, selected portions of the cylinder block may be designed with different materials to increase the engine's strength to weight ratio without compromising desired combustion chamber characteristics. Moreover, integrally molding the cylinder liner and bulkhead insert with the cylinder block increases the coupling strength of the block assembly. Additionally, coupling the bulkhead insert direct to the cylinder head enables combustion loads travelling through the head bolts to be tied to reactive loads from the crankshaft bearing caps. As a result, loads are more evenly distributed throughout the engine, thereby increasing the engine's longevity.

The above advantages and other advantages, and features of the present description will be readily apparent from the following Detailed Description when taken alone or in connection with the accompanying drawings.

It should be understood that the summary above is provided to introduce in simplified form a selection of concepts that are further described in the detailed description. It is not meant to identify key or essential features of the claimed subject matter, the scope of which is defined uniquely by the claims that follow the detailed description. Furthermore, the claimed subject matter is not limited to implementations that solve any disadvantages noted above or in any part of this disclosure. Additionally, the above issues have been recognized by the inventors herein, and are not admitted to be known.

BRIEF DESCRIPTION OF THE DRAWINGS

FIGS. 2-3 are drawn approximately to scale, however other relative dimensions may be utilized if desired.

DETAILED DESCRIPTION

An engine having a composite cylinder block with an integrally molded cylinder liner defining the boundary of at least one cylinder is described herein. The engine further includes a bulkhead insert extending through at least a portion of the cylinder block. The cylinder liner and the bulkhead insert may be constructed out of a metal while the cylinder block may be constructed out of a thermal set or thermo-molded composite material, such as a polymeric material, carbon fiber, etc. In this way, a material having a high strength to weight ratio may be used to construct the block surrounding the cylinder liner and the bulkhead insert. Therefore, a desired structural integrity of the block may be maintained while decreasing the weight of the block or the structural integrity of the block may be increased without increasing the block's weight. Furthermore, providing an integrally molded metallic cylinder liner in the composite cylinder block enables a different material better suited to handle the heat and pressure generated via combustion to be used to construct the cylinders. In this way, the characteristics of various sections of the engine can be tuned based on desired engine operating characteristics. Consequently, the engine's strength to weight ratio is increased without compromising the combustion chamber's abrasion and heat transfer characteristics.

Furthermore, by providing a bulkhead insert loads generated in the crankshaft, for instance, may be directly transferred to the cylinder head. In this way, loads from the crankshaft may be more evenly transferred to different sections of the engine. As a result, the longevity of the engine is increased. Additionally, the cylinder liner may be includes various structural characteristics which provide greater coupling strength between the cylinder liner and the block. For instance, the cylinder liner may include a block attachment lip extending around a peripheral surface of the liner. The contours of the block attachment lip provide a greater amount of bonding strength between the thermo-molded composite cylinder block and the cylinder liner during molding.

Figure 1:
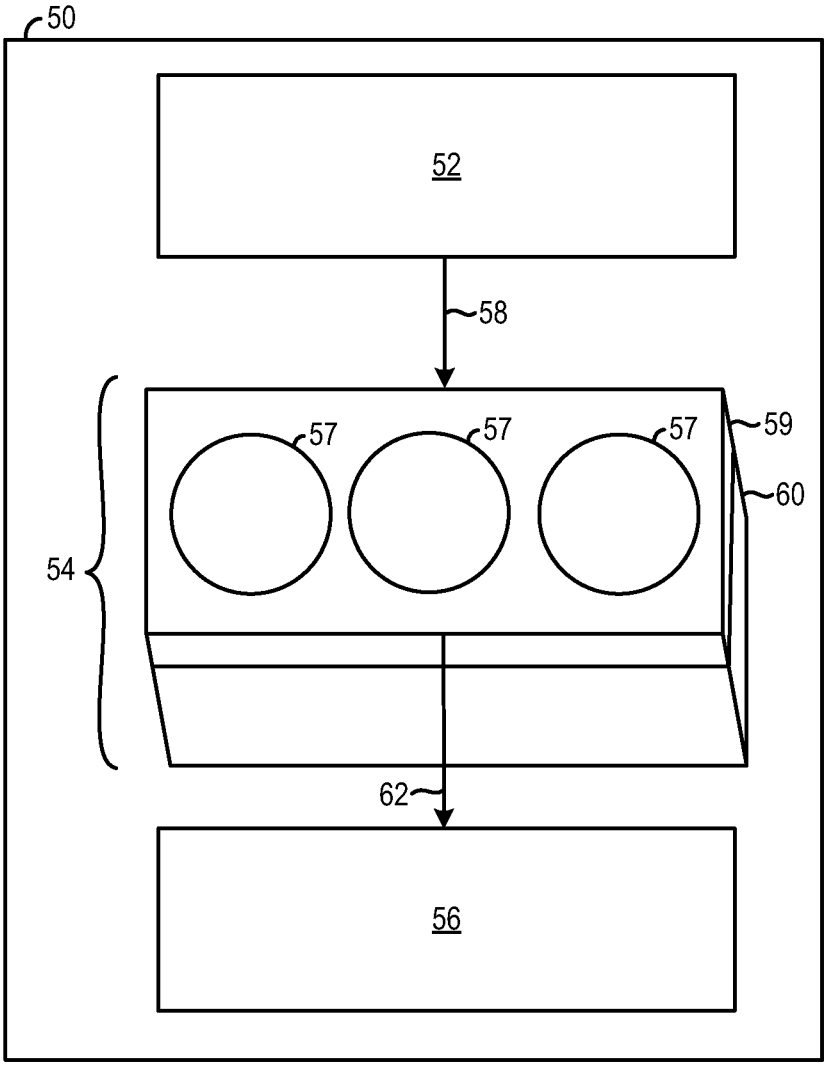
FIG. 1 shows a schematic depiction of a vehicle having an engine including a molded composite cylinder block assembly attached to a cylinder head.

FIG. 1 shows a schematic depiction of a vehicle 50 including an intake system 52, an engine 54, and an exhaust system 56. The intake system 52 is configured to provide intake air to cylinders 57 in the engine 54. The cylinders may also be referred to as combustion chambers. Arrow 58 denotes the fluidic communication between the intake system 52 and the engine 54. Specifically, the intake system 52 may be configured to provide intake air to each of the cylinders in the engine. The intake system 52 may include various intake conduits, an intake manifold, a throttle, etc. Furthermore, a turbocharger including a compressor and a turbine may be included in the engine 54, in one example.

The engine 54 includes a cylinder head 59 coupled to a molded cylinder block assembly 60 forming the plurality of cylinders 57. In the depicted example, the engine includes 3 cylinders in an inline configuration. However, alternate cylinder arrangements and cylinder quantities have been contemplated. For instance, the cylinders may be arranged in banks in a V-type configuration, the cylinder may be arranged in a horizontally opposed configuration, etc. A multi-stroke combustion cycle may be implemented. For instance, four or two stroke combustion cycles have been contemplated. It will be appreciated that the engine 54 depicted in FIG. 1 has structural complexity that is not depicted in FIG. 1. Specifically, the molded cylinder block assembly 60 may include a plurality of components which may be constructed out of different materials. For instance, the molded cylinder block assembly 60 and therefore the engine 54 may include a composite cylinder block, a cylinder liner, and one or more bulkhead inserts. The molded cylinder block assembly components are described in greater detail herein with regard to FIGS. 2-3.

Arrow 62 depicts the fluidic communication between the engine 54 and the exhaust system 56. It will be appreciated that each of the cylinders 57 in the engine 54 may be in fluidic communication with the exhaust system 56. The exhaust system 56 may include a plurality of components such as an exhaust manifold, emission control devices (e.g., catalysts, filters, etc.), mufflers, etc.

Figure 2:
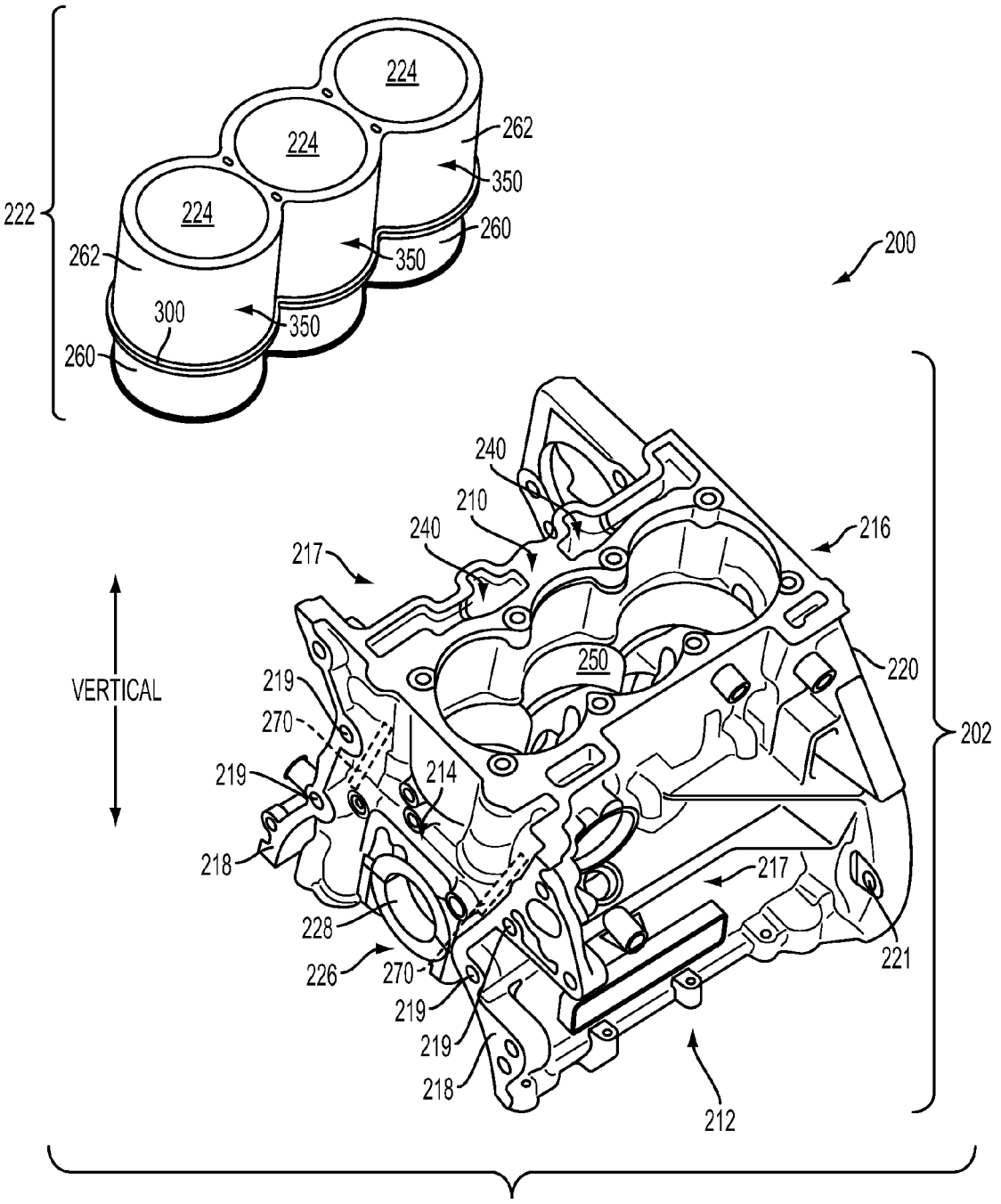
FIG. 2 shows a first example molded cylinder block assembly.

FIG. 2 shows an exploded view of an example molded (e.g., thermal molded) cylinder block assembly 200. The molded cylinder block assembly 200 may be similar to the molded cylinder block assembly 60 shown in FIG. 1 and therefore may be included in the engine 54. The molded cylinder block assembly 200 includes a composite cylinder block 202. A number of suitable manufacturing methods may be used to construct the composite cylinder block 202. For instance, the composite cylinder block may be constructed via a thermal setting technique such as injection molding. Therefore, the composite cylinder block 202 may be specifically referred to as a thermal set composite cylinder block, in one example. The manufacturing methods for the composite cylinder block 202 are described in greater detail herein with regard to FIG. 4.

Suitable materials used to construct the composite cylinder block may include a polymeric material such as a thermal-set resin, carbon fiber, etc. It will be appreciated that plastic resin may be less expensive than carbon fiber. The composite material may be thermally stable when exposed to heat generated from combustion operation. For instance, the composite material may be thermally stable when operating in a temperature range between 120° C. and 200° C., in one example. Furthermore, the composite material may also have a desired stiffness and strength for handling stresses and strains generated in the engine or by other vehicle components, such as the transmission. It will be appreciated that constructing a portion of the engine out of a composite material enables a material with a high strength to weight ratio to be used selected areas of the engine where favorable abrasive and thermal characteristics may not be necessitated. In this way, different sections of the engine may be tuned to achieve different end-use characteristics to increase the engine's strength to weight ratio and the engine's longevity.

The composite cylinder block 202 includes a top side 210, a bottom side 212, a front side 214, a rear side 216, and two lateral sides 217. A front engine cover attachment interface 218 having attachment openings 219 is shown included in the front side 214. The attachment interface 218 may be coupled to a front engine cover. Additionally, the rear side 216 includes a transmission bell housing interface 220. The transmission bell housing interface 220 may be coupled to a transmission bell housing included a transmission via attachment openings 221 configured to receive an attachment apparatus. The powertrain bending witnessed at the transmission to cylinder block bell housing would require additional structural support. This support is found in the form of a one piece metallic ring with torque limiters and threaded bosses which is molded into the cylinder block at time of manufacturing the block at interface 220 and include mounting features 221 within the structure for added strength and load carrying capability. Additionally, the transmission may be coupled to a crankshaft coupled to pistons in the engine. The composite cylinder block includes cylinder head attachment openings 221. Furthermore, the cylinder head attachment openings 221 are configured to attach to bolts or other suitable attachment apparatuses extending from a cylinder head, such as the cylinder head 59 shown in FIG. 1. In one example, metal support structures 270 molded into the composite cylinder block may be positioned adjacent to the attachment interface 218 and/or the transmission bell housing interface 220. The metal support structures 270 may be at least partially enclosed via the composite cylinder block 202. In this way, additional support may be provided to selected areas of the molded composite cylinder block assembly.

Continuing with FIG. 2, the molded cylinder block assembly 200 further includes a cylinder liner 222. The cylinder liner 222 forms a continuous piece of material, in the depicted example. Additionally, the cylinder liner 222 defines a portion of the boundary of a plurality of cylinders 224. The cylinder liner may comprise a metal (e.g., powdered metal) such as iron (e.g., graphite iron), aluminum, etc.) In assembled configuration the cylinder liner 222 may be positioned in an opening 250 in the composite cylinder block 202. Furthermore, the cylinder liner 222 is formed out of a single continuous piece of material, in the depicted example. However other cylinder liner configurations have been contemplated. For instance, a cylinder liner having two or more sections spaced away from one another may be utilized in other examples.

Additionally, the molded cylinder block assembly 200 further includes a plurality bulkhead inserts 226. A single bulkhead insert is shown in FIG. 2. However, the assembly includes four bulkhead inserts, in the depicted example. Furthermore, each of the bulkhead inserts 226 includes a bearing cap 228. The bearing cap 228 may enclose a crankshaft bearing. Thus, the number of bulkhead inserts in the molded cylinder block assembly is greater than the number of cylinders in the assembly, in the depicted example. However, cylinder block assemblies with a different number of bulkhead inserts have been contemplated. For instance, only a single bulkhead insert may be included in the molded cylinder block assembly 200. The bulkhead inserts 226 extend (e.g., vertically extend) through the composite cylinder block 202. A vertical axis is provided for reference. However, other relative dimensions may be used if desired. Longitudinal and lateral axes are also provided for reference in FIG. 2. The bulkhead inserts 226 may be coupled to a cylinder head, such as the cylinder head 59 shown in FIG. 1. In this way, the bulkhead inserts ties combustion loads travelling through the head bolts with reactive loads from the crankshaft bearing caps. The bulkhead inserts 226 and cylinder liner 222 is shown in greater detail in FIG. 3.

Continuing with FIG. 2, the composite cylinder block 202 and the cylinder liner 222 may be constructed out of different materials. For instance, the composite cylinder block 202 may be constructed out of a thermal-set material such as a polymeric material (e.g., a plastic resin) and/or carbon fiber. On the other hand, the cylinder liner may be constructed out of a metal (e.g., powdered metal) such as iron, aluminum, etc. The cylinder liner 222 may also be coated with a material such as iron/iron-oxide plasma spray deposition coating known as PTWA for wear resistance and increased longevity. The aluminum cylinder liner 222 may also have a traditional cast iron sleeve as part of its structure to withstand higher combustion pressures. These liner combinations for materials used are chosen based on engine application of combustion method such as natural aspirated or boosted induction systems. Additionally, the composite cylinder block 202 and the bulkhead inserts 226 may be constructed out of different materials. For instance, the bulkhead inserts 226 may be constructed out of a metal such as CGI iron, powder metal, aluminum, etc. Additionally, the bulkhead inserts 226 and the cylinder liner 222 may be constructed out of different materials in one example or the same material in other examples stated herein for engine system applications for resolving durability and longevity issues.

The composite cylinder block 202 includes water jacket cavities 240. The two cylinder head oil drain back cavities 240 as an example may be in fluidic communication with the oil retuning from the cylinder head back down into the oil pan in a separate channel or cavities surrounding the cylinder liner 222 yet separated by composite material forming cylinder block 202, discussed in greater detail herein with regard to FIG. 2.

External surfaces of the cylinder liner 222 may have varying degrees of roughness. It will be appreciated that surfaces with a greater roughness have an increased coupling strength with the composite cylinder block when it is thermo-formed. A first external surface 260 may have a greater roughness than a second external surface 262 in the cylinder liner 222. In this way, the roughness of the external surfaces of the cylinder liner may be varied to provide greater coupling strength in certain areas of the cylinder liner. As shown, the first external surface 260 is positioned below the second external surface 262. Furthermore, the first external surface 260 is positioned below a block attachment lip 300. It will be appreciated that a water jacket cavity 350 may surround the second external surface 262. In an assembled configuration in the region of the second external surface 262 the cylinder liner 222 may not be in face sharing contact with the cylinder block 202. On the other hand, in the region of the first external surface 260 the cylinder liner may be in face sharing contact with the cylinder block. Additionally, the thickness of the cylinder liner 222 does not vary along a vertical axis in the region around the first and second external surfaces (260 and 262). However, other cylinder liner geometries have been contemplated. The block attachment lip 300 is described in greater detail herein.

Figure 3:
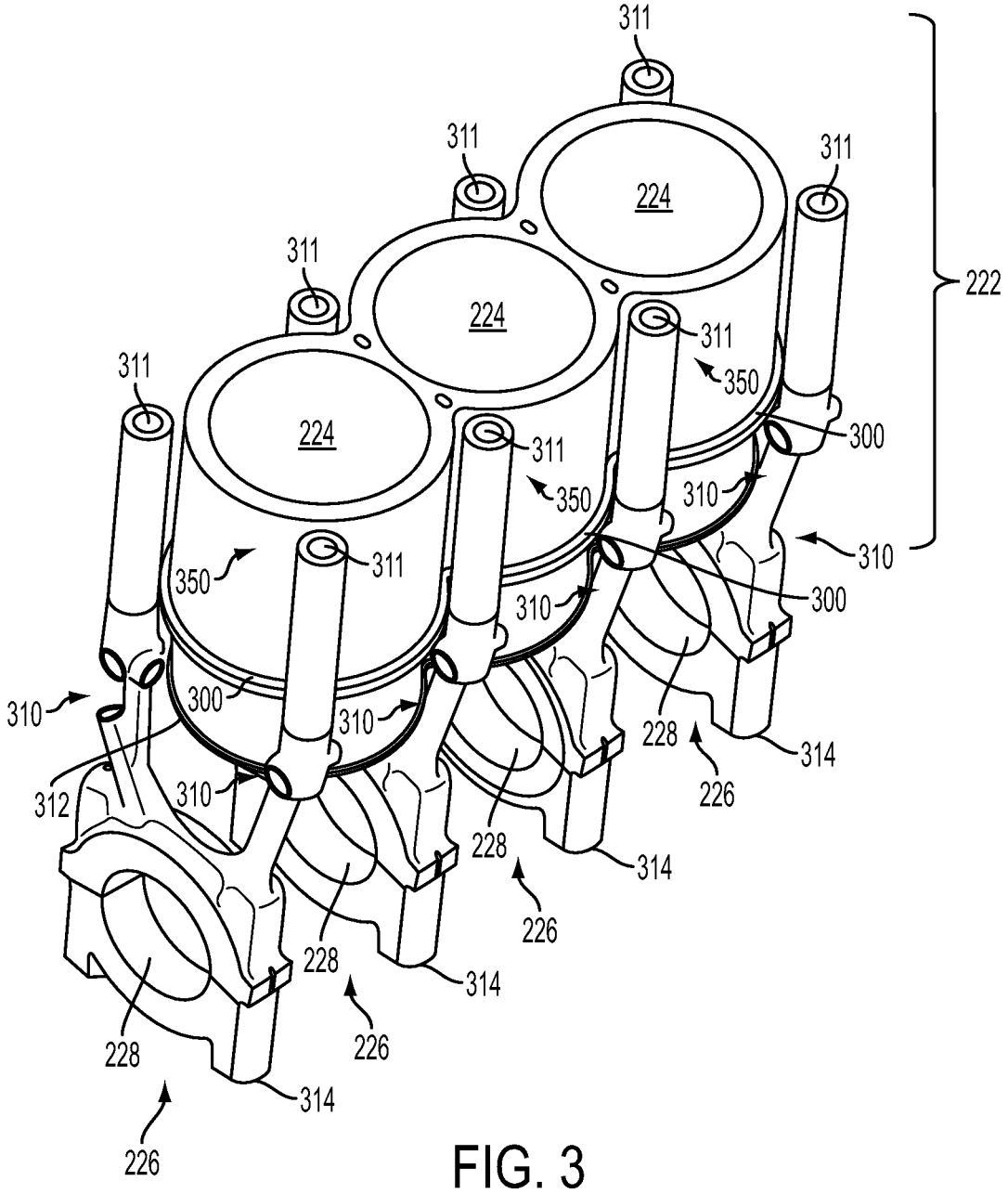
FIG. 3 shows an exploded view of the molded cylinder block assembly illustrated in FIG. 2.

FIG. 3 shows a detailed view of the cylinder liner 222 and the bulkhead inserts 226. The cylinders 224 are also shown in FIG. 3. The cylinder liner 222 includes a block attachment lip 300 having a greater radius than other surfaces surrounding the block attachment lip. The block attachment lip 300 extends around a peripheral surface 301 of the cylinder liner 222. The block attachment lip 300 is in face sharing contact with a portion of the composite cylinder block 202. Therefore, the composite cylinder block may be directly molded with the cylinder liner 222. The block attachment lip 300 enables stronger connection to be formed between the cylinder liner and the composite cylinder block. In one example, the block attachment lip 300 may continuously extend around the cylinder liner 222. However in other examples, the block attachment lip may be segmented. In one example, the block attachment lip 300 may define a boundary (e.g., lower boundary) of the water jacket cavity. In this way, the water jacket may be separated from oil in a crankcase positioned below the block.

As previously discussed, the bulkhead inserts 226 extend vertically through the composite cylinder block 202, shown in FIG. 2. Each of the bulkhead inserts 226 includes two supports 310 extending (e.g., vertically extending) through the composite cylinder block 202, shown in FIGS. 2 and 3. Specifically, the supports extend above a bottom 312 of the cylinders 224. The bearing caps 228 of the bulkhead inserts 226 are also shown in FIG. 3.

Each of the supports 310 includes an opening 311 which may be coupled (e.g., directly coupled) to an attachment apparatus extending from a cylinder head, such as the cylinder head 59 shown in FIG. 1. Coupling the bulkhead inserts 226 to the cylinder head enables the forces generated by the crankshaft to be more evenly distributed throughout the engine, thereby reducing the likelihood of fractures, bending, etc., of engine components. Additionally, sections of the supports 310 are positioned on either lateral sides of the cylinder liner 222. In this way, the bulkhead inserts can extend through the composite cylinder block past a portion of the cylinder liner.

Each of the bulkhead inserts 226 includes a bearing cap 228. The bearing caps 228 are configured to enclose a crankshaft bearing. The crankshaft bearings enabling supported rotation of a crankshaft. The bearing caps 228 may be cracked to facilitate installation of the crankshaft bearings and the crankshaft. Openings 314 in the bottom of the bearing caps 228 are configured to receive attachment apparatuses. For instance, the bearing caps 228 may be cracked to enable crankshaft installation. Therefore, attachment apparatuses may extend through the openings 314 to attach the cracked portion of the bearing cap to the bulkhead insert to enable attachment of the crankshaft and the crankshaft bearings.

The molded cylinder block assembly further includes the water jacket cavity 350 at least partially surrounding the cylinder liner 222. The water jacket cavity 350 may be included in an engine cooling system. The engine cooling system may include components such as a heat exchanger, a pump, etc.

Figure 4:
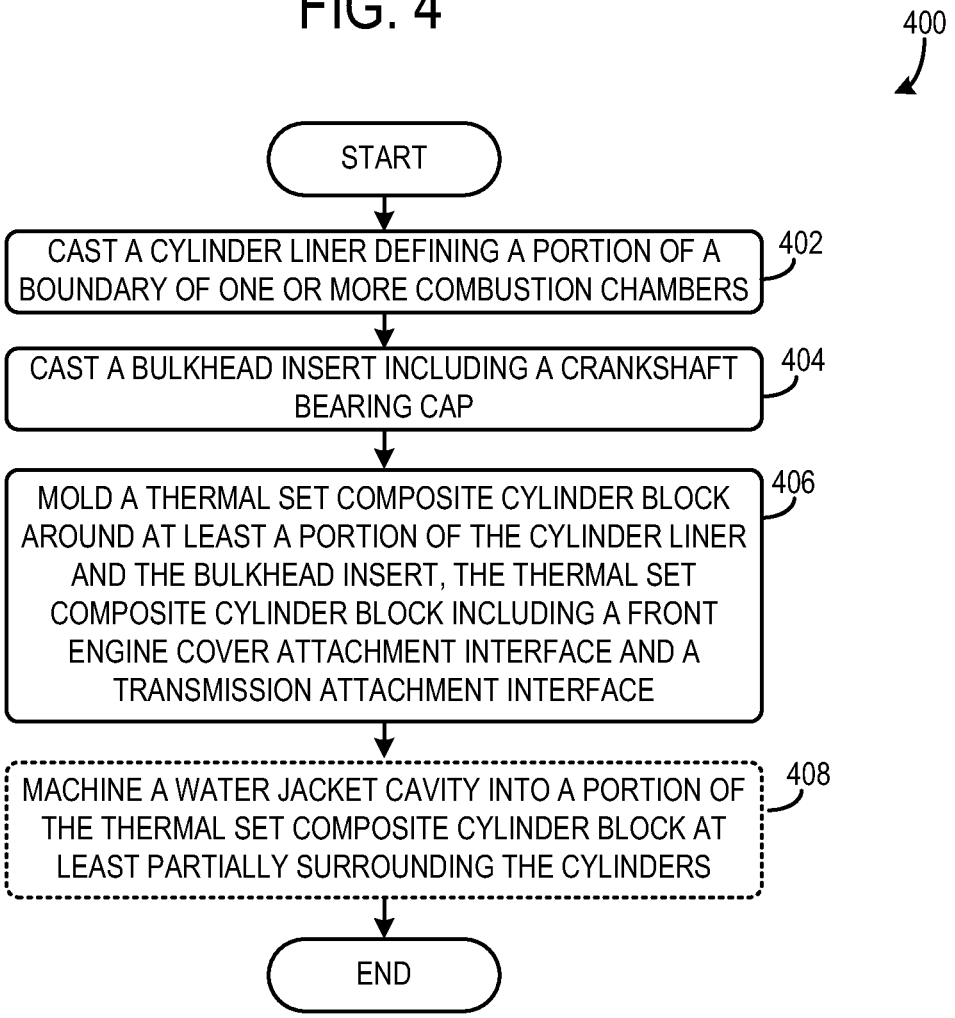
FIG. 4 shows a method for manufacturing an engine.

FIG. 4 shows a method 400 for manufacturing an engine. The method may be used to manufacture the engine discussed above with regard to FIGS. 1-3 or may be used to manufacture another suitable engine.

At 402 the method includes casting a cylinder liner defining a portion of a boundary of one or more combustion chambers. Next at 404 the method includes casting a bulkhead insert including a crankshaft bearing cap. It will be appreciated that the bulkhead insert may include Further in other examples, a plurality of bulkhead inserts may be cast.

At 406 the method includes molding a thermal set composite cylinder block around at least a portion of the cylinder liner and the bulkhead insert, the thermal set composite cylinder block including a front engine cover attachment interface and a transmission attachment interface. Next at 408 the method includes machining a water jacket cavity into a portion of the thermal set composite cylinder block at least partially surrounding the cylinders. It will be appreciated that in other examples the method may not include step 408. In such an example, a wax core may be positioned around the cylinder liner prior to molding the composite cylinder block. The wax core may define the contours of a water jacket cavity at least partially surrounding the cylinder liner. It will be appreciated that machining the water jacket cavity into the composite cylinder block may enable the water jacket cavity design to be determined at a late stage in the manufacturing process. Consequently, the adaptability of the engine manufacturing process may be increased.

Note that the example control and estimation routines included herein can be used with various engine and/or vehicle system configurations. The control methods and routines disclosed herein may be stored as executable instructions in non-transitory memory. The specific routines described herein may represent one or more of any number of processing strategies such as event-driven, interrupt-driven, multi-tasking, multi-threading, and the like. As such, various actions, operations, and/or functions illustrated may be performed in the sequence illustrated, in parallel, or in some cases omitted. Likewise, the order of processing is not necessarily required to achieve the features and advantages of the example embodiments described herein, but is provided for ease of illustration and description. One or more of the illustrated actions, operations and/or functions may be repeatedly performed depending on the particular strategy being used. Further, the described actions, operations and/or functions may graphically represent code to be programmed into non-transitory memory of the computer readable storage medium in the engine control system.

It will be appreciated that the configurations and routines disclosed herein are exemplary in nature, and that these specific embodiments are not to be considered in a limiting sense, because numerous variations are possible. For example, the above technology can be applied to V-6, I-4, I-6, V-12, opposed 4, and other engine types. The subject matter of the present disclosure includes all novel and non-obvious combinations and sub-combinations of the various systems and configurations, and other features, functions, and/or properties disclosed herein.

The following claims particularly point out certain combinations and sub-combinations regarded as novel and non-obvious. These claims may refer to "an" element or "a first" element or the equivalent thereof. Such claims should be understood to include incorporation of one or more such elements, neither requiring nor excluding two or more such elements. Other combinations and sub-combinations of the disclosed features, functions, elements, and/or properties may be claimed through amendment of the present claims or through presentation of new claims in this or a related application. Such claims, whether broader, narrower, equal, or different in scope to the original claims, also are regarded as included within the subject matter of the present disclosure.

The invention claimed is:

1. An engine comprising:

a thermal set composite cylinder block including a front engine cover attachment interface and a transmission attachment interface;

a metal cylinder liner integrally molded with the composite cylinder block, the cylinder liner defining a portion of a boundary of a cylinder; and a metal bulkhead insert comprising a crankcase bearing cap and two supports vertically extending through the cylinder block, past a portion of the cylinder liner, where head attachment openings in each of the supports are directly coupled to attachment apparatuses extending from a cylinder head.

2. The engine of claim 1, where the cylinder liner includes an external surface having a greater roughness than the remaining external surfaces of the cylinder liner.

3. The engine of claim 2, where the external surface is positioned below a water jacket cavity surrounding the cylinder.

4. The engine of claim 1, where the cylinder liner comprises a powdered metal.

5. The engine of claim 4, where the cylinder liner comprises iron.

6. The engine of claim 1, where the composite cylinder block comprises a resin.

7. The engine of claim 6, where the composite cylinder block comprises a carbon fiber material.

8. The engine of claim 1, where the cylinder liner is coated with at least one of iron and iron-oxide plasma spray deposition coating.

9. The engine of claim 1, where the cylinder liner includes an attachment lip defining a lower boundary of a water jacket surrounding the cylinder liner and in face sharing contact with a portion of the composite cylinder block.

10. The engine of claim 1, where the composite cylinder block is configured to operate at temperatures up to 200° C.

11. An engine comprising:

a thermal set composite cylinder block including a front engine cover attachment interface and a transmission attachment interface;

a cylinder liner constructed from a different material than a composite cylinder block and integrally molded with the composite cylinder block, the cylinder liner defining a portion of a boundary of a cylinder; and a bulkhead insert constructed from a different material than the composite cylinder block, the bulkhead insert including a crankcase bearing cap, two supports vertically extending through the composite cylinder block past a portion of the cylinder liner, and head attachment openings in each of the supports directly coupled to attachment apparatuses extending from a cylinder head.

12. The engine of claim 11, where the cylinder liner includes a first external surface having a greater roughness than a second external surface.

13. The engine of claim 12, where the first external surface is positioned vertically below the second external surface.

14. The engine of claim 13, where the first external surface is positioned below a water jacket cavity at least partially surrounding the cylinder liner.

15. The engine of claim 12, where the cylinder liner includes a block attachment lip positioned between the first and second external surfaces.

16. The engine of claim 11, where the composite cylinder block comprises a polymeric material.

17. A molded cylinder block assembly comprising:

a thermal set composite cylinder block including a front engine cover attachment interface and a transmission attachment interface;

a cylinder liner constructed from a different material than a composite cylinder block and integrally molded with the composite cylinder block, the cylinder liner defining a portion of a boundary of a cylinder and including a first external surface having a greater roughness than a second external surface; and a bulkhead insert integrally molded with the composite cylinder block, the bulkhead insert constructed from a different material than the composite cylinder block, the bulkhead insert including a crankcase bearing cap, two supports vertically extending through the composite cylinder block past a portion of the cylinder liner and including head attachment openings in each of the supports directly coupled to attachment apparatuses extending from a cylinder head.

18. The molded cylinder block assembly of claim 17, where the cylinder liner is formed of a continuous piece of material.

19. The molded cylinder block assembly of claim 17, where first external surface is positioned below the second external surface.

* * * * *